US008893668B2

(12) United States Patent
Jo et al.

(10) Patent No.: US 8,893,668 B2
(45) Date of Patent: Nov. 25, 2014

(54) SYSTEM AND METHOD FOR COOLING ENGINE OF VEHICLE

(71) Applicant: Hyundai Motor Company, Seoul (KR)

(72) Inventors: Won Jin Jo, Hwaseong-si (KR); Jerok Chun, Hwaseong-si (KR); Kimin Park, Ansan-si (KR); Hyun Jun Hong, Anyang-si (KR); Young Jic Kim, Hwaseong-si (KR); Hyun Kyu Woo, Gunpo-si (KR); Hwan Duk Kim, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 16 days.

(21) Appl. No.: 13/718,464

(22) Filed: Dec. 18, 2012

(65) Prior Publication Data

US 2014/0083377 A1 Mar. 27, 2014

(30) Foreign Application Priority Data

Sep. 24, 2012 (KR) ..... 10-2012-0106035

(51) Int. Cl.
*F01P 7/14* (2006.01)
*F01P 7/16* (2006.01)

(52) U.S. Cl.
CPC . *F01P 7/14* (2013.01); *F01P 7/162* (2013.01); *F01P 7/165* (2013.01); *F01P 2025/33* (2013.01)
USPC ..... 123/41.14; 123/41.43; 123/41.44; 701/34.4

(58) Field of Classification Search
CPC ..... F01P 3/02; F01P 3/20; F01P 5/10; F01P 7/14; F01P 11/00; F01P 11/02
USPC ..... 123/41.02, 41.14, 41.43, 41.44; 701/32.8, 34.4
See application file for complete search history.

(56) References Cited

U.S. PATENT DOCUMENTS

| | | | | |
|---|---|---|---|---|
| 3,981,279 | A * | 9/1976 | Bubniak et al. | 123/41.14 |
| 4,662,317 | A * | 5/1987 | Ogawa | 123/41.21 |
| 4,721,071 | A * | 1/1988 | Fujigaya et al. | 123/41.21 |
| 4,766,852 | A * | 8/1988 | Hirano et al. | 123/41.21 |
| 4,782,795 | A * | 11/1988 | Kubozuka et al. | 123/41.21 |
| 4,793,403 | A * | 12/1988 | Vataru et al. | 165/95 |
| 4,809,769 | A * | 3/1989 | Vataru et al. | 165/95 |

(Continued)

FOREIGN PATENT DOCUMENTS

| | | | |
|---|---|---|---|
| JP | 08-226322 | A | 9/1996 |
| JP | 2004-019452 | A | 1/2004 |

*Primary Examiner* — Noah Kamen
*Assistant Examiner* — Grant Moubry
(74) *Attorney, Agent, or Firm* — Morgan, Lewis & Bockius LLP

(57) ABSTRACT

A method of cooling an engine of a vehicle includes measuring a temperature of a cylinder head of the engine, determining whether the measured temperature of the cylinder head may be equal to or lower than a predetermined temperature, when the temperature of the cylinder head may be equal to or lower than the predetermined temperature, moving coolant of the cylinder head and a cylinder block to a separate coolant tank, determining whether the measured temperature of the cylinder head may be equal to or higher than a specific temperature, and when the measured temperature of the cylinder head may be equal to or higher than the specific temperature, supplying coolant stored in the coolant tank to the cylinder head or the cylinder block.

11 Claims, 5 Drawing Sheets

(56) References Cited

U.S. PATENT DOCUMENTS

| | | | | |
|---|---|---|---|---|
| 4,899,807 | A * | 2/1990 | Vataru et al. | 165/95 |
| 6,196,168 | B1 * | 3/2001 | Eckerskorn et al. | 123/41.33 |
| 6,929,189 | B2 * | 8/2005 | Takei et al. | 236/34.5 |
| 8,074,611 | B2 * | 12/2011 | Schell et al. | 123/41.1 |
| 8,439,003 | B2 * | 5/2013 | Araki et al. | 123/41.1 |
| 2009/0038563 | A1 * | 2/2009 | Takarai | 123/41.02 |
| 2010/0206882 | A1 * | 8/2010 | Wessels et al. | 220/562 |
| 2012/0240877 | A1 * | 9/2012 | Takahashi et al. | 123/41.02 |

* cited by examiner

SYSTEM AND METHOD FOR COOLING ENGINE OF VEHICLE

CROSS-REFERENCE TO RELATED APPLICATION

The present application claims priority to Korean Patent Application No. 10-2012-0106035 filed on Sep. 24, 2012, the entire contents of which is incorporated herein for all purposes by this reference.

BACKGROUND OF THE INVENTION

1. Field of the Invention

The present invention relates to an engine cooling system of a vehicle, and more particularly, to a system and a method for cooling an engine of a vehicle, which controls cooling water passing through a cylinder block and a cylinder head.

2. Description of Related Art

In general, when a temperature of an engine is low, incomplete combustion occurs to cause air pollution and deterioration of engine performance, and when the engine is overheated, a fire is broken out and engine performance deteriorates. Accordingly, it is necessary to maintain a temperature of the engine as a set temperature, so that a cooling system is included for cooling an engine.

A cooling system of a vehicle in the related art includes an engine in which coolant flows along a flow path formed at an exterior wall of a cylinder block, a radiator in which high temperature coolant discharged from the engine flows, a thermostat for controlling a flow direction of the coolant discharged from the engine, and a water pump for compulsively circulating coolant by receiving power from a crankshaft of the engine.

In the engine cooling system, the coolant heated by the engine is heat-exchanged with outside air through the radiator and cooled, and then introduced in the engine again, and heat-exchanged with the high temperature engine according to an operation of the water pump linked with the crankshaft.

The engine is maintained at an appropriate temperature by the engine cooling system, so that the engine is prevented from being damaged due to high temperature combustion heat.

However, as described above, the coolant was added for the purpose of preventing the engine from being overheated, but when the engine is in a cold state before the engine is heated to an appropriate temperature like at an initial time of turning on the engine, the coolant negatively affects rapid warm-up of the engine, thereby causing discharge of poisonous gas to be increased and fuel efficiency to deteriorate.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a cooling system and method of a vehicle for improving preheating performance through rapid warm-up of an engine at an initial stage of turning on the engine, thereby decreasing discharge of poisonous gas and improving fuel efficiency.

In an aspect of the present invention, a method of cooling an engine of a vehicle, may include measuring a first temperature of a cylinder head of the engine, determining whether the first temperature of the cylinder head is equal to or lower than a first predetermined temperature, when the first temperature of the cylinder head is equal to or lower than the first predetermined temperature, moving coolant of the cylinder head and a cylinder block to a coolant tank, determining whether a second temperature of the cylinder head is equal to or higher than a second predetermined temperature, and when the second temperature of the cylinder head is equal to or higher than the second predetermined temperature, supplying the coolant stored in the coolant tank to the cylinder head or the cylinder block.

The measuring of the first temperature of the cylinder head is performed when the engine is turned on.

The measuring of the second temperature of the cylinder head is performed when the engine is turned on.

The method may further may include when the engine is turned off, measuring a third temperature of the cylinder head, determining whether the third temperature of the cylinder head measured after the engine is turned off is equal to or lower than the first predetermined temperature, and when the third temperature of the cylinder head measured after the engine is turned off is equal to or lower than the first predetermined temperature, moving the coolant of the cylinder head and the cylinder block to the coolant tank.

The moving of the coolant of the cylinder head and the cylinder block to the coolant tank may include stopping an operation of an electronic coolant pump configured to circulate the coolant in a coolant line, opening an air hole solenoid valve connected to the coolant line to supply outside air therein, closing a coolant cutoff solenoid valve configured to selectively supply the coolant to a radiator, and operating a coolant control piston and adjusting a supply of the coolant.

The coolant line is disposed adjacent to the cylinder head and the cylinder block of the engine.

The first and second temperatures of the cylinder head are measured by a head temperature sensor installed adjacently to the cylinder head.

The first predetermined temperature is approximately 50° C.

The second predetermined temperature is approximately 90° C.

In another aspect of the present invention, a system for cooling an engine of a vehicle may include a coolant line through which coolant passes and cools a cylinder head and a cylinder block of the engine, a head temperature sensor measuring a temperature of the cylinder head, an air hole solenoid valve selectively connecting the coolant line to outside air, a coolant cutoff solenoid valve connected to the coolant line and selectively supplying the coolant to a radiator, a coolant tank connected to the coolant line and separately storing the coolant of the coolant line therein, a coolant control piston slidably installed in the coolant tank to adjust a supply of the coolant in the coolant line, a coolant pump connected to the coolant line and circulating the coolant in the coolant line, and a control unit controlling the system for cooling the engine, wherein in a case where the engine is turned on or the engine is turned off, when a first temperature measured by the head temperature sensor is equal to or lower than a first predetermined temperature, the control unit stops an operation of the coolant pump and moves the coolant of the coolant line to the coolant tank, and then when a second temperature measured by the head temperature sensor is equal to or higher than a second predetermined temperature, the control unit supplies the coolant stored in the coolant tank to the coolant line.

The control unit moves the coolant of the coolant line to the coolant tank by stopping the operation of the coolant pump, opening the air hole solenoid valve, closing the coolant cutoff solenoid valve, and operating the coolant control piston.

The first predetermined temperature is 50° C.

The second predetermined temperature is 90° C.

The coolant cutoff solenoid valve is installed between a thermostat and the radiator.

The thermostat is installed between the coolant line and the radiator and opens a flow path between the coolant line and the radiator when a temperature of the coolant exceeds a predetermined temperature.

The coolant pump is an electronic coolant pump of which driving is electronically controlled by the control unit.

When the engine is turned off, the control unit measures a third temperature of the cylinder head, determines whether the third temperature of the cylinder head measured after the engine is turned off is equal to or lower than the first predetermined temperature, and when the third temperature of the cylinder head measured after the engine is turned off is equal to or lower than the first predetermined temperature, moves the coolant of the cylinder head and the cylinder block to the coolant tank.

The control unit moves the coolant of the coolant line to the coolant tank by stopping the operation of the coolant pump, opening the air hole solenoid valve, closing the coolant cutoff solenoid valve, and operating the coolant control piston.

According to the system and the method of cooling the engine of the vehicle according to the exemplary embodiment of the present invention, the warm-up of the engine may rapidly progress in a section of an initial stage of turning on the engine, thereby improving fuel efficiency and reducing poisonous exhaust gas.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
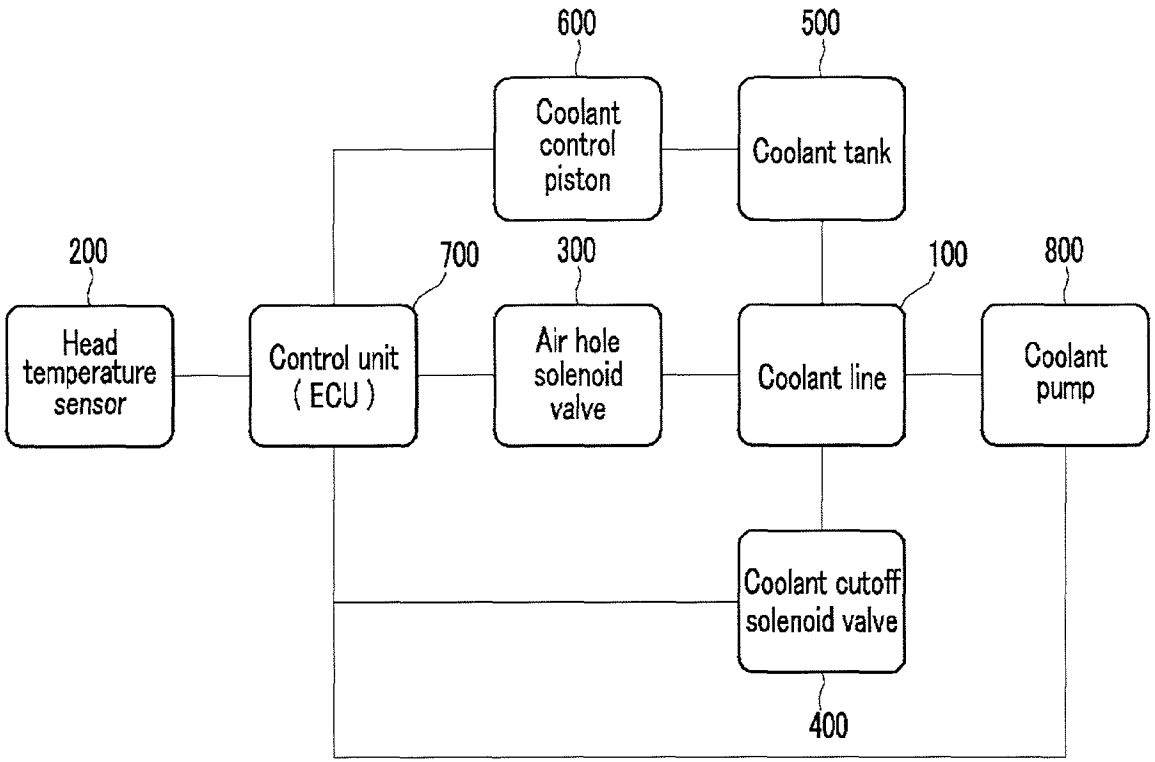
FIG. 1 is a block diagram of a system for cooling an engine of a vehicle according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, exemplary embodiments of the present invention will be described in detail with reference to the accompanying drawings.

Figure 2:
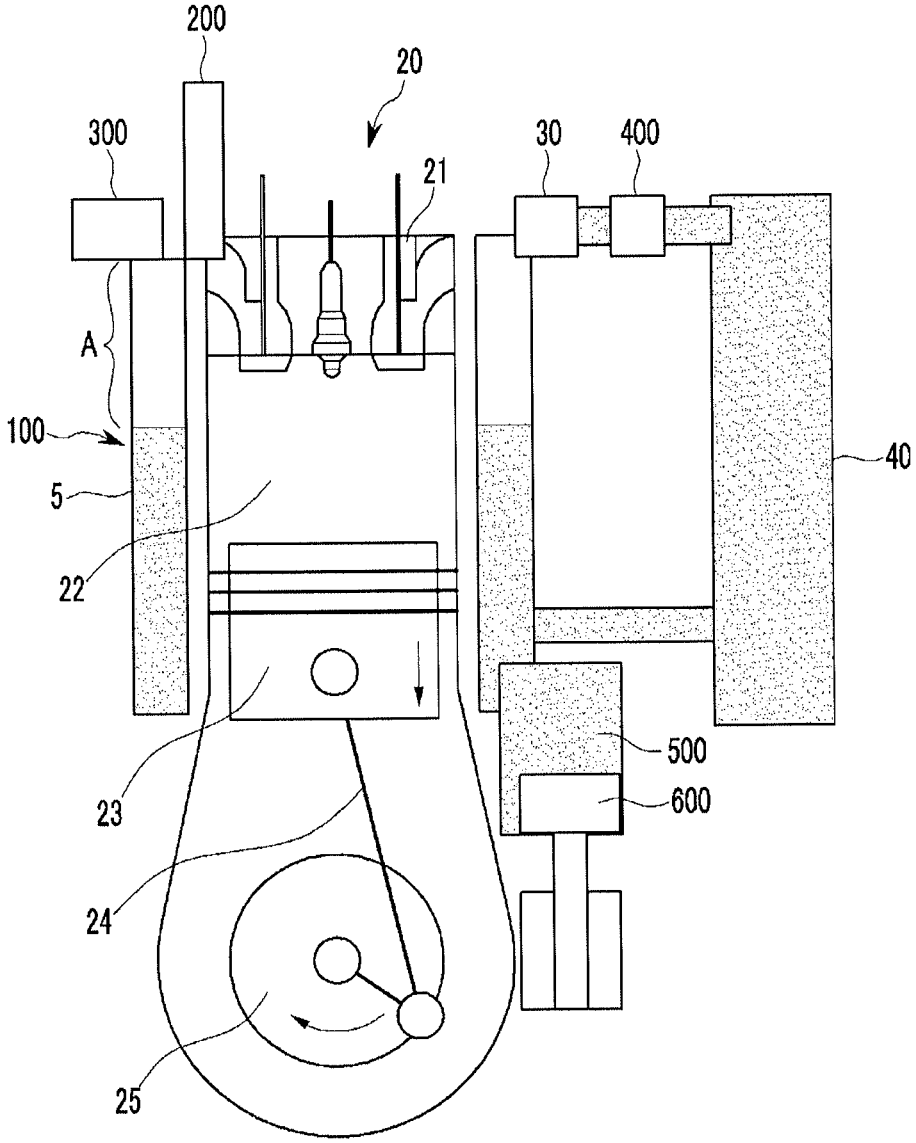
FIG. 2 is a schematic diagram of a system for cooling an engine of a vehicle according to an exemplary embodiment of the present invention.
Figure 3:
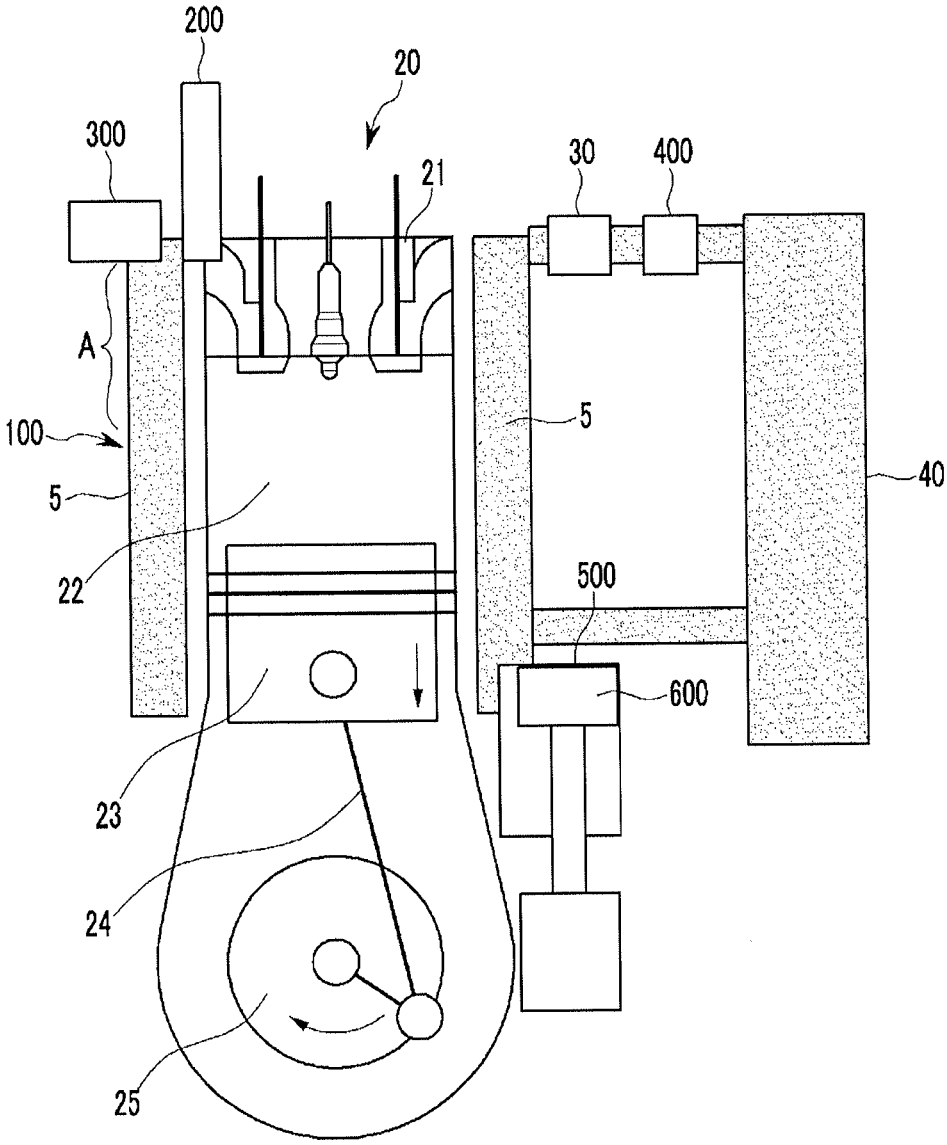
FIG. 3 is a schematic diagram of a system for cooling an engine of a vehicle according to an exemplary embodiment of the present invention.

FIG. 1 is a block diagram of a system for cooling an engine of a vehicle according to an exemplary embodiment of the present invention, and FIGS. 2 and 3 are schematic diagrams of a system for cooling an engine of a vehicle according to an exemplary embodiment of the present invention.

As illustrated in FIGS. 1 to 3, a system for cooling an engine of a vehicle according to an exemplary embodiment of the present invention includes a coolant line 100, a head temperature sensor 200, an air hole solenoid valve 300, a coolant cutoff solenoid valve 400, a coolant tank 500, a coolant control piston 600, a coolant pump 800, and a control unit 700.

In general, an engine of the vehicle 20 may include a cylinder block 22 in which a piston 23 is operated, and a cylinder head 21 positioned on an upper portion of the cylinder block 22 as illustrated in FIG. 2, and the piston 23 of the engine linearly reciprocates according to an intake, compression, explosion, and exhaust stroke inside a cylinder of the cylinder block 22. The piston of the engine 23 is connected with a crankshaft 25 by a connecting rod 24, and thus a linear reciprocating movement is shifted to a rotational movement. When the intake, compression, explosion, and exhaust stroke progresses after the engine 20 is turned on, temperatures of the cylinder head 21 and the cylinder block 22 gradually increase. When the temperatures of the cylinder head 21 and the cylinder block 22 reach a predetermined level, it may be determined that the engine 20 sufficiently warms up.

The coolant line 100, which is a part serving as a passage through which the coolant passes, is installed for preventing the cylinder head 21 and the cylinder block 22 from being overheated.

In one or multiple exemplary embodiments, as illustrated in FIGS. 2 and 3, the coolant line 100 may be installed adjacently to the cylinder head 21 and the cylinder block 22 of the engine. When the coolant stored in a coolant storage device is supplied along the coolant line 100 according to an operation of the coolant pump, the coolant absorbs heat of the adjacent cylinder head 21 and cylinder block 22 to lower the temperature of the cylinder (head) and the cylinder block 22. Then, the coolant selectively passes through the radiator 40 or returns to the coolant storage device again through a bypass passage by the thermostat 30 to circulate the coolant line.

The coolant line 100 may be divided into a coolant inlet line in which the coolant 5 flows in a direction of the cylinder head 21 and the cylinder block 22, and a coolant discharge line for making the coolant having passed through the cylinder head 21 and the cylinder block 22 head the thermostat 30.

The head temperature sensor 200 is a device for measuring a temperature of the cylinder head 21. According to the exemplary embodiment of the present invention, as illustrated in FIGS. 2 and 3, the head temperature sensor 200 is installed on the cylinder head 21 to measure a temperature of the cylinder head 21 in real time and transmits information on the measured temperature of the cylinder head 21 to the control unit 700.

The air hole solenoid valve 300 is connected to one side of the coolant line 100 to selectively supply outside air to the coolant line 100. The air hole solenoid valve 300 is opened/closed by using electromagnetic force of an electronic coil, and the opening/closing thereof may be controlled by the control unit 700. When the partial coolant 5 flows in the coolant tank 500, the air hole solenoid valve 300 is opened, so that the air may flow in a predetermined space A as illustrated in FIG. 2. This will be described in detail below.

The coolant cutoff solenoid value 400 selectively supplies the coolant to the radiator 40. The coolant cutoff solenoid valve 400 is also opened/closed by using electromagnetic force of an electronic coil, and the opening/closing thereof may be controlled by the control unit 700.

In one or multiple exemplary embodiments, the coolant cutoff solenoid valve 400 may be installed in a flow path between the thermostat 30 and the radiator 40 as illustrated in FIGS. 2 and 3. The thermostat 30 selectively opens/closes the flow path through which the coolant flows to the radiator 40. In general, when a temperature of the coolant exceeds a predetermined temperature, the thermostat 30 opens the flow path through which the coolant flows to the radiator 40 so that the coolant is cooled, and when a temperature of the coolant is equal to or lower than the predetermined temperature, the thermostat 300 cuts off the flow path through which the coolant flows to the radiator 40 and opens the bypass flow path so that the coolant is circulated without passing through the radiator, and thus a temperature of the coolant may be uniformly maintained.

According to the exemplary embodiment of the present invention, the coolant cutoff solenoid valve 400 is installed between the thermostat 30 and the radiator 40 to selectively open/close the flow path according to the control of the control unit 700.

The coolant tank 500 is separately included from the coolant storage device to separately store a part of the coolant of the coolant line 100.

In one or multiple exemplary embodiments, the coolant tank 500 may be installed under the coolant line 100, and may be formed in a predetermined size so as to have a capacity for storing a part of the coolant of the coolant line 100.

The coolant control piston 600 is slidably installed in the coolant tank 500 to adjust the supply of the coolant of the coolant line 100.

In one or multiple exemplary embodiments, as illustrated in FIGS. 2 and 3, the coolant control piston 600 may be controlled by the control unit 700. The coolant control piston 600 is installed under the coolant tank 500 to vertically move so as to make a part of the coolant of the coolant line 100 flow in the coolant tank 500 or supply the coolant of the coolant tank 500 to the coolant line 100.

The coolant pump (water pump) 800 serves to cool heat of the cylinder head 21 and the cylinder block 22 of the engine 20 by circulating the coolant in each part of the engine 20, the radiator 40, and the like, along the coolant line 100.

In one or multiple exemplary embodiments, the coolant pump 800 may be an electronic coolant pump (electric water pump) and may be controlled by the control unit 700. The electronic coolant pump is driven by a motor controlled by the control unit. Accordingly, the electronic coolant pump may be operated regardless of turning on or off the engine and a speed of revolutions of the engine, and determine a flow rate of the coolant.

The control unit 700 is a part generally controlling the system for cooling the engine of the vehicle, and may be an electronic control unit (ECU) of a vehicle.

The control unit 700 selectively opens/closes the coolant pump 800, the air hole solenoid valve 300, and the coolant cutoff solenoid valve 400 based on the information on the temperature of the cylinder head 21 received from the head temperature sensor 200, and may control the vertical movement of the coolant control piston 600 in linkage with the selective open/close of the valves.

The control unit 700 may be implemented as one or more processors operated by a set program, and the set program may be programmed so as to perform each step of a method of cooling an engine of a vehicle according to an exemplary embodiment of the present invention.

When the temperature measured by the head temperature sensor 200 is equal to or lower than a predetermined temperature, the control unit 700 moves the coolant of the coolant line 100 to the coolant tank 500, and when the temperature measured by the head temperature sensor 200 is equal to or higher than a specific temperature, the control unit 700 supplies the coolant stored in the coolant tank 500 to the coolant line 100.

In one or multiple exemplary embodiments, when the temperature measured by the head temperature sensor 200 is equal to or lower than 50° C., the control unit 700 stops the operation of the coolant pump 800, opens the air hole solenoid valve 300, and moves the coolant control piston 600 to a lower portion of the coolant tank 500 in a state where the coolant cutoff solenoid valve 400 is closed, so that a part of the coolant 5 of the coolant line 100 flows in the coolant tank 500. Accordingly, as illustrated in FIG. 2, the part of the coolant 5 is drained from the coolant line 100 and the air flows in the coolant line 100 instead, so that a vacant space of the coolant corresponding to portion A is created in upper portions of the cylinder 21 and the cylinder block 22. Since heat exchange medium are decreased by the space A in which the coolant is absent, the heat generated in the engine is less lost to the coolant, so that the temperature of the engine may be more rapidly increased. Accordingly, in a situation similar to an initial stage of turning on the engine, the warm up of the cylinder head 21 and the cylinder block 22 may rapidly progress.

In the meantime, in one or multiple exemplary embodiments, when the temperature of the cylinder head 21 measured by the head temperature sensor 200 is equal to or higher than a specific temperature, for example, 90° C. according to the sufficient progress of the warm up of the cylinder head and the cylinder block 22, the control unit 700 opens the air hole solenoid valve 300 and the coolant cutoff solenoid valve 400 so as to move up the coolant control piston 600, so that the coolant 5 stored in the coolant tank 500 is supplied to the coolant line 100. Further, the control unit 700 circulates the coolant by operating the coolant pump 800. Accordingly, as illustrated in FIG. 3, the coolant is circulated in a state where the coolant 5 is supplied up to the upper portions of the cylinder head 21 and the cylinder block 22, so that the cylinder head 21 and the cylinder block 22 are prevented from being overheated.

Hereinafter, a method of cooling an engine of a vehicle according to an exemplary embodiment of the present invention will be described with reference to the drawings.

Figure 4:
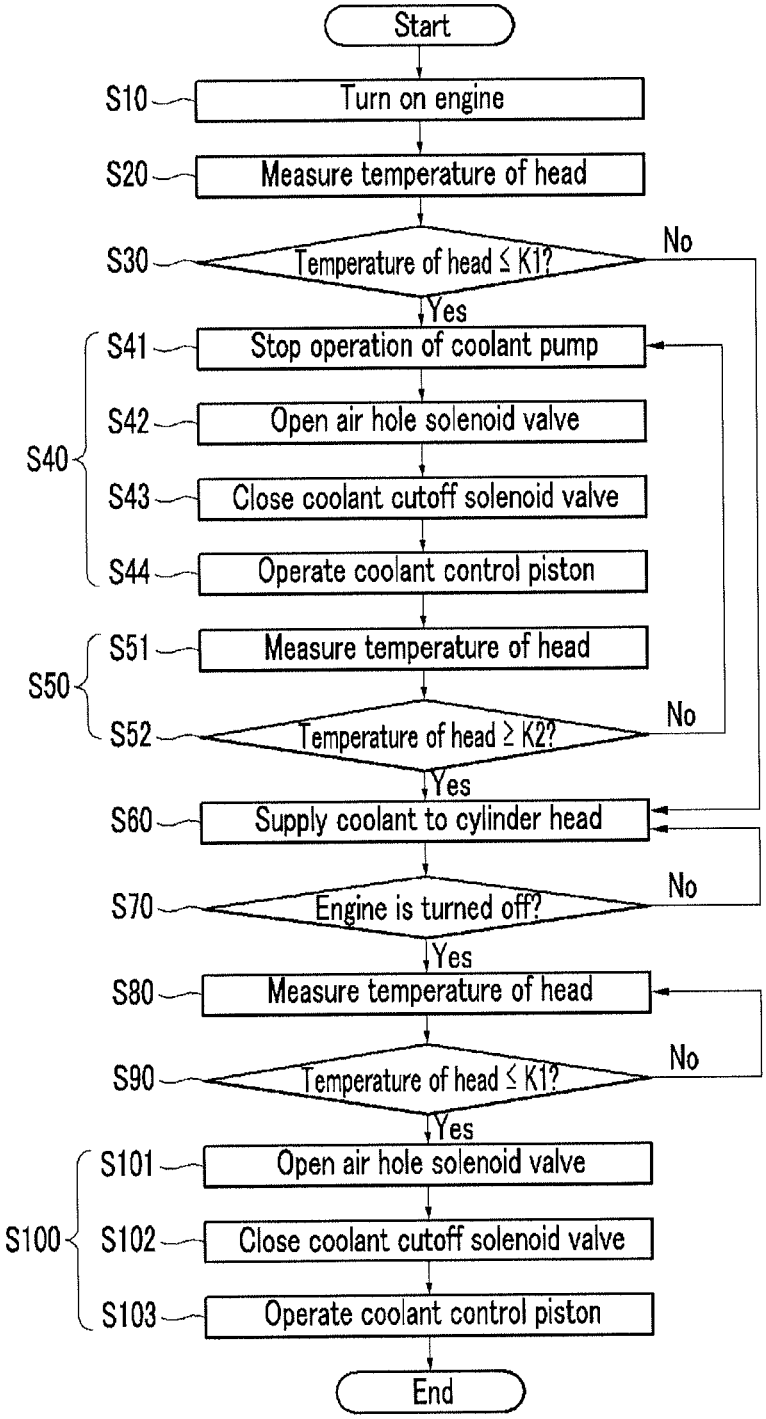
FIG. 4 is a flowchart of a method of cooling an engine of a vehicle according to an exemplary embodiment of the present invention.

FIG. 4 is a flowchart illustrating a method of cooling an engine of a vehicle according to an exemplary embodiment of the present invention.

First, when the engine of the vehicle is turned on (S10), the head temperature sensor 200 measures a temperature of the cylinder head 21 (S20). Information on the measured temperature of the cylinder head 21 is transmitted to the control unit 700 in real time.

The control unit 700 determines whether the temperature of the cylinder head 21 is equal to or lower than a preset predetermined temperature K1 (S30). In one or multiple exemplary embodiments, the predetermined temperature K1 may be 50° C. When the temperature of the cylinder head 21 exceeds the predetermined temperature K1, the cylinder head 21 and the cylinder block 22 are in a sufficient warm-up state, so that the control unit 700 supplies the coolant to the cylinder head 21 and the cylinder block 22 (S60).

However, when the measured temperature of the cylinder head 21 is equal to or lower than the predetermined temperature K1, the cylinder head 21 and the cylinder block 22 are not in a sufficient warm-up state, so that the control unit 700 moves a part of the coolant of the coolant line 100 to the separate coolant tank 500 (S40).

In one or multiple exemplary embodiments, the step S40 of moving the part of the coolant to the separate coolant tank 500 may include, as illustrated in FIGS. 2 to 4, stopping an operation of the electronic coolant pump (electric water pump) for circulating the coolant in the coolant line 100 (S41), opening the air hole solenoid valve 300 connected to the coolant line 100 to selectively supply outside air (S42), closing the coolant cutoff solenoid valve 400 for selectively supplying the coolant to the radiator 40 (S43), and operating the coolant control piston 600 for adjusting the supply of the coolant (S44) by the control unit 700.

The circulation of the coolant is stopped in the coolant line according to the stop of the coolant pump (S41), the air hole solenoid valve 300 is opened (S42), the coolant cutoff solenoid valve 400 is closed (S43), and the coolant control piston 600 is operated in a down direction (S44), so that the part of the coolant 5 may be moved to the coolant tank 500. Accordingly, the air flows in the space A in which the coolant is absent in the upper portions of the cylinder head 21 and the cylinder block 22, thereby facilitating the warm-up of the cylinder head 21 and the cylinder block 22.

Next, the control unit 700 determines whether the temperature of the cylinder head is equal to or higher than a specific temperature K2 (S50). The head temperature sensor 200 measures the temperature of the cylinder head 21 and transmits the measured temperature to the control unit (S51), and the control unit 700 determines whether the temperature of the cylinder head 21 received from the head temperature sensor 200 is equal to or higher than the preset specific temperature K2 (S52). In one or multiple exemplary embodiments, the specific temperature K2 may be 90° C.

When the temperature of the cylinder head 21 is equal to or higher than the specific temperature K2, the control unit 700 prevents the cylinder head 21 and the cylinder block 22 from being overheated by supplying the coolant 5 stored in the coolant tank 500 to the coolant line 100 (S60).

In one or multiple exemplary embodiments, the control unit 700 may move the coolant 5 of the coolant tank 500 to the coolant line 100 by opening the air hole solenoid valve 300 and the coolant cutoff solenoid valve 400 and operating the coolant control piston 600 in an upper direction, and normally circulate the coolant in the coolant line by operating the coolant pump 800 again.

When the temperature of the cylinder head 21 is equal to or higher than the specific temperature K2, the cylinder head 21 and the cylinder block 22 are in a sufficient warm-up state, so that the control unit 700 supplies and circulates the coolant 5, thereby cooling the cylinder head 21 and the cylinder block 22. However, when the temperature of the cylinder head 21 is not equal to or higher than the specific temperature K2, the cylinder head 21 and the cylinder block 22 is not in a sufficient warm-up state, so that the control unit 700 continuously maintains a state in which a part of the coolant of the coolant line 100 is moved to the separate coolant tank 500 (S40).

The control unit 700 determines whether the engine is turned off (S70). When the engine is not turned off, the control unit 700 supplies the coolant to the cylinder head and circulates the coolant (S60), and when the engine is turned off, the head temperature sensor 200 measures the temperature of the cylinder head 21 and transmits the measured temperature to the control unit 700 (S80). Since step S80 is performed after the engine 20 of the vehicle is turned off, the step S80 may be performed by using preliminary power of the vehicle.

The control unit 700 determines whether the temperature of the cylinder head 21 is equal to or lower than the predetermined temperature K1 (S90).

Since the engine is turned off, the cylinder head 21 and the cylinder block 22 are naturally cooled according to the passage of time.

Accordingly, when the temperature of the cylinder head 21 is equal to or lower than the predetermined temperature K1, the control unit 700 removes a part of the coolant 5 from the upper portions of the cylinder head 21 and the cylinder block 22 and moves the removed part to the separate coolant tank (S100).

In one or multiple exemplary embodiments, step S100 may include opening the air hole solenoid valve 300 connected to the coolant line 100 to selectively supply the outside air (S101), closing the coolant cutoff solenoid valve 400 for selectively supplying the coolant to the radiator 40 (S102), and operating the coolant control piston 600 for adjusting the supply of the coolant by the control unit 700. In this case, the coolant pump 800 is stopped by the turn-off of the engine, and a part of the coolant 5 is moved to the coolant tank 500 and the air flows in the space in which the coolant is absent by steps S101 to S103.

Steps S90 to S100 are also performed after the engine 20 is turned off, so that steps S90 to S100 may be performed by using preliminary power of the vehicle.

Accordingly, when the engine is turned on next time, the part of the coolant 5 has been already removed in the cylinder head 21 and the cylinder block 22, so that the warm-up of the engine may be rapidly performed immediately after the engine is turned on.

Figure 5:
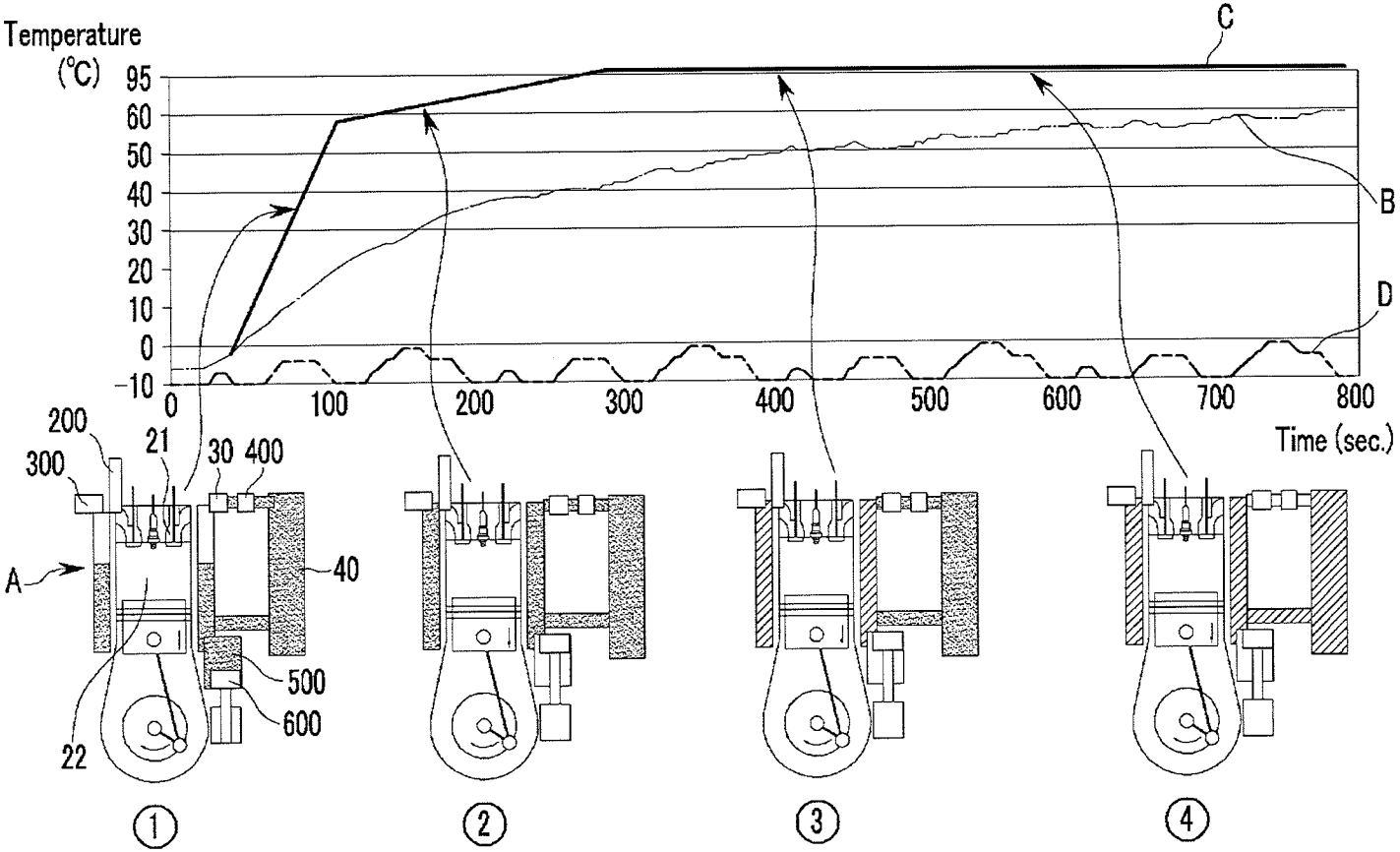
FIG. 5 is a graph of comparison of engine warm-up states between the related art and the present invention.

FIG. 5 is a graph of comparison of cases of the system and the method of cooling the engine of the vehicle between an exemplary embodiment of the present invention and the related art.

In FIG. 5, line B indicates a warm-up temperature of the engine in the related art, line C indicates a warm-up temperature of the engine according to an exemplary embodiment of the present invention, and line D indicates a speed of a vehicle.

As illustrated in FIG. 5, case (1) is a state in which the temperature of the cylinder head 21 is equal to or lower than the predetermined temperature K1.

In this case, according to the exemplary embodiment of the present invention, the part of the coolant moves to the coolant tank 500, so that the coolant is absent in portion A, thereby facilitating the warm-up of the engine. In the graph, an inclination of line C according to the exemplary embodiment of the present invention is remarkably large than that of line B in the related art. Accordingly, according to the exemplary embodiment of the present invention, the engine may remarkably rapidly warm up at the initial stage of turning on the engine.

Case (2) in FIG. 5 is a state in which the engine sufficiently warms up and the temperature of the cylinder head 21 is equal to or higher than the specific temperature K2. In this case, the control unit 700 supplies the coolant stored in the coolant tank 500 to the coolant line 100 by opening the coolant cutoff solenoid valve 400 and operating the coolant control piston 600, and circulates the coolant by operating the coolant pump 800.

Case (3) in FIG. 5 illustrates a state in which the temperature of the cylinder head 21 is higher than the specific temperature K2, but is lower than a temperature set in the thermostat 30. Accordingly, the coolant is in a state where the coolant is circulated through the bypass passage and is not circulated by passing through the radiator 40 by the thermostat 30.

Case (4) in FIG. 5 illustrates a state in which a temperature of the coolant further increases by the cylinder head 21 and the cylinder block 22 to be equal to or higher than the temperature set in the thermostat 30. In this case, the thermostat 30 is opened so that the coolant is circulated by passing through the radiator 40, and thus the temperature of the coolant does not further increase and is maintained at a predetermined temperature.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A method of cooling an engine of a vehicle, comprising:

measuring a first temperature of a cylinder head of the engine;

determining whether the first temperature of the cylinder head is equal to or lower than a first predetermined temperature;

when the first temperature of the cylinder head is equal to or lower than the first predetermined temperature, moving coolant of the cylinder head and a cylinder block to a coolant tank;

determining whether a second temperature of the cylinder head is equal to or higher than a second predetermined temperature;

when the second temperature of the cylinder head is equal to or higher than the second predetermined temperature, supplying the coolant stored in the coolant tank to the cylinder head or the cylinder block;

wherein the measuring of the first temperature of the cylinder head is performed when the engine is turned on;

when the engine is turned off, measuring a third temperature of the cylinder head;

determining whether the third temperature of the cylinder head measured after the engine is turned off is equal to or lower than the first predetermined temperature; and when the third temperature of the cylinder head measured after the engine is turned off is equal to or lower than the first predetermined temperature, moving the coolant of the cylinder head and the cylinder block to the coolant tank.

2. The method of claim 1, wherein the measuring of the second temperature of the cylinder head is performed when the engine is turned on.

3. The method of claim 1, wherein the first and second temperatures of the cylinder head are measured by a head temperature sensor installed adjacently to the cylinder head.

4. The method of claim 1, wherein the first predetermined temperature is approximately 50° C.

5. The method of claim 1, wherein the second predetermined temperature is approximately 90° C.

6. A method of cooling an engine of a vehicle, comprising:

measuring a first temperature of a cylinder head of the engine;

determining whether the first temperature of the cylinder head is equal to or lower than a first predetermined temperature;

when the first temperature of the cylinder head is equal to or lower than the first predetermined temperature, moving coolant of the cylinder head and a cylinder block to a coolant tank;

determining whether a second temperature of the cylinder head is equal to or higher than a second predetermined temperature;

when the second temperature of the cylinder head is equal to or higher than the second predetermined temperature, supplying the coolant stored in the coolant tank to the cylinder head or the cylinder block, wherein:

the moving of the coolant of the cylinder head and the cylinder block to the coolant tank includes:

stopping an operation of an electronic coolant pump configured to circulate the coolant in a coolant line;

opening an air hole solenoid valve connected to the coolant line to supply outside air therein;

closing a coolant cutoff solenoid valve configured to selectively supply the coolant to a radiator; and operating a coolant control piston and adjusting a supply of the coolant.

7. The method of claim 6, wherein:

the measuring of the second temperature of the cylinder head is performed when the engine is turned on.

8. The method of claim 6, wherein the coolant line is disposed adjacent to the cylinder head and the cylinder block of the engine.

9. The method of claim 6, wherein the first and second temperatures of the cylinder head are measured by a head temperature sensor installed adjacently to the cylinder head.

10. The method of claim 6, wherein the first predetermined temperature is approximately 50° C.

11. The method of claim 6, wherein the second predetermined temperature is approximately 90° C.

* * * * *